US006095854A

United States Patent [19]

Sommer et al.

[11] Patent Number: 6,095,854

[45] Date of Patent: Aug. 1, 2000

[54] PANEL MOUNTING SYSTEM FOR ELECTRICAL CONNECTORS

[75] Inventors: Edward S. Sommer, Naperville; Richard R. Edgley, Elmhurst; Gary E. Polgar, Bolingbrook, all of Ill.

[73] Assignee: Molex Incorporated, Lisle, Ill.

[21] Appl. No.: 09/290,352

[22] Filed: Apr. 12, 1999

[51] Int. Cl.[7] ..... H01R 13/73

[52] U.S. Cl. ..... 439/545; 439/544; 439/562

[58] Field of Search ..... 439/545, 560, 439/562, 567, 544

[56] References Cited

U.S. PATENT DOCUMENTS

| | | | |
|---|---|---|---|
| 4,352,538 | 10/1982 | Fowler | 339/126 |
| 5,127,852 | 7/1992 | Cravens et al. | 439/545 |
| 5,338,226 | 8/1994 | Bryce et al. | 439/571 |
| 5,344,327 | 9/1994 | Brunker et al. | 439/108 |
| 5,407,363 | 4/1995 | Polgar et al. | 439/546 |
| 5,772,469 | 6/1998 | Polgar et al. | 439/546 |
| 5,800,208 | 9/1998 | Ishizuka et al. | 439/557 |

*Primary Examiner*—Paula Bradley
*Assistant Examiner*—Truc Nguyen
*Attorney, Agent, or Firm*—James C. Paschall

[57] ABSTRACT

A system is provided for mounting an electrical connector in a panel having an opening with at least one locating slot in the opening. A connector includes a housing insertable into the opening in the panel. The housing has at least one outwardly projecting locating flange for passing through the locating slot of the opening as the housing is inserted thereinto. The housing has at least one outwardly projecting stop flange spaced axially from the locating flange for abutting the panel when the housing is in its inserted position. The housing is movable within the opening in the panel to a latched position. A latch arm projects outwardly from the housing for engagement with a latch surface on the panel when the housing is in its latched position. A protective shroud is disposed about a substantial portion of the latch arm to protect the latch arm against breakage. In one embodiment, the protective shroud is of a sufficiently large size to combine with the housing to substantially close the opening in the panel when the housing is in its latched position.

26 Claims, 6 Drawing Sheets

PANEL MOUNTING SYSTEM FOR ELECTRICAL CONNECTORS

FIELD OF THE INVENTION

This invention generally relates to the art of electrical connectors and, particularly, to a system for mounting an electrical connector in an opening in a panel or other planar substrate.

BACKGROUND OF THE INVENTION

Panel mounted electrical connectors are known in the art, and such a connector generally includes a housing mounting a plurality of terminals for mating with a complementary connector. The housing may be mounted to a generally rigid panel for mating of the connector with the complementary connector through an opening in the panel, or the housing may be mounted on the panel simply for structural or support purposes within a circuit interconnection system.

Various means have been used to mount the connector to a panel, such as mounting clips or brackets operatively associated between the connector housing and the panel to mount and hold the connector to the panel. In other systems, the connector housing is inserted into the opening in the panel to an insertion position and then moved relative to the panel, within the opening, to a final mounted position whereat the connector is latched by latch means directly on the connector housing.

One of the problems with panel mounted connectors of the character described above is that the latch means typically projects outwardly from the connector housing, such as a cantilevered latch arm. These projecting latch means are prone to become engaged with extraneous objects during handling and, consequently, are prone to breakage. Another problem arises when the connector housing is moved from its insertion position to its final mounted position. The opening in the panel typically is enlarged to accommodate this movement. Consequently, when the connector housing is in its final mounted position, a portion of the opening is exposed and extraneous objects can be inserted through the opening. The present invention is directed to solving these various problems.

SUMMARY OF THE INVENTION

An object, therefore, of the invention is to provide a new and improved system for mounting an electrical connector in a panel or other planar substrate.

In the exemplary embodiment of the invention, a panel has first and second sides and an opening with at least one locating slot extending radially from the opening. A connector has a housing insertable from one side of the panel along an axis to an insertion position into the opening in the panel. The housing includes at least one radially extending locating flange for passing through the locating slot of the opening as the housing is inserted thereinto. The housing also includes at least one radially extending stop flange spaced axially and, preferably, transversely from the locating flange for abutting the one side of the panel when the locating flange clears the opposite side of the panel. The housing is movable within the opening in the panel from the insertion position to a latched position. A latch arm projects from the connector housing and is engageable with a latch surface on the panel when the housing is in the latched position. A protective shroud is disposed about a substantial portion of the latch arm to protect the latch arm against breakage.

As disclosed herein, at least one locating flange and at least one stop flange are disposed on each of two opposite sides of the connector housing. In one embodiment of the invention, the latch arm and protective shroud are disposed at a third side of the connector housing. The latch surface on the panel comprises an edge of the opening in the panel. The latch arm includes a latch projection for engaging the edge of the panel. The latch arm is provided as a flexible latch arm and the protective shroud is provided by a rigid plate. Preferably, the latch arm and the shroud are integral with the connector housing.

In a second embodiment of the invention, the latch arm and protective shroud are disposed at one of the two opposite sides of the connector housing. The latch surface on the panel comprises an edge of the at least one locating slot. The latch arm includes a latch projection for engaging the edge of the slot. Again, the latch arm is provided as a flexible latch arm and the protective shroud is provided as a rigid plate. However, in the second embodiment, the latch arm projects from the at least one stop flange, and the protective shroud extends between a pair of the stop flanges including the one stop flange.

The invention contemplates that, in the one embodiment, the protective shroud be of a sufficiently large size to combine with the housing to substantially close the opening in the panel when the housing is in its latched position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
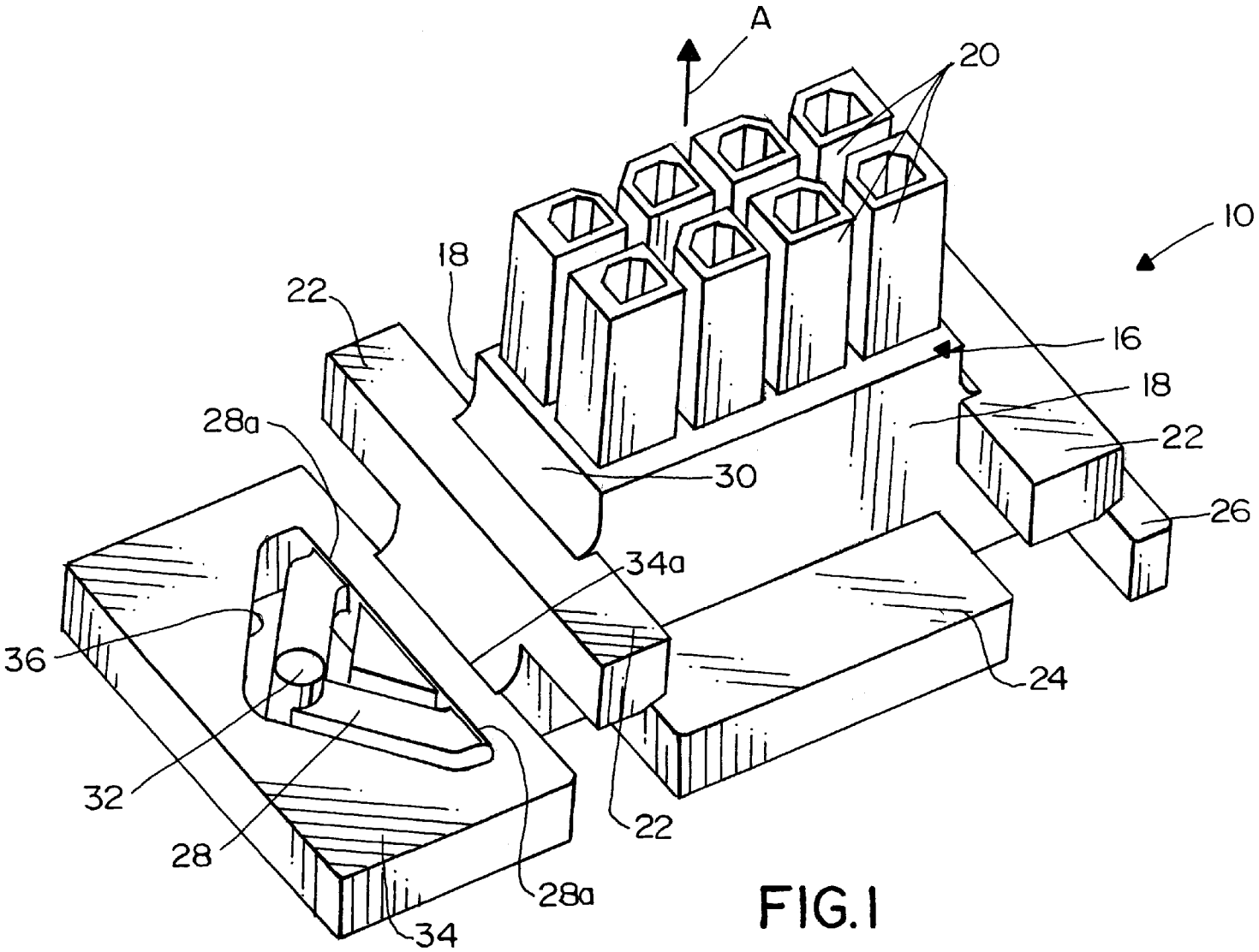
FIG. 1 is a perspective view of a first embodiment of an electrical connector embodying the concepts of the invention.
Figure 2:
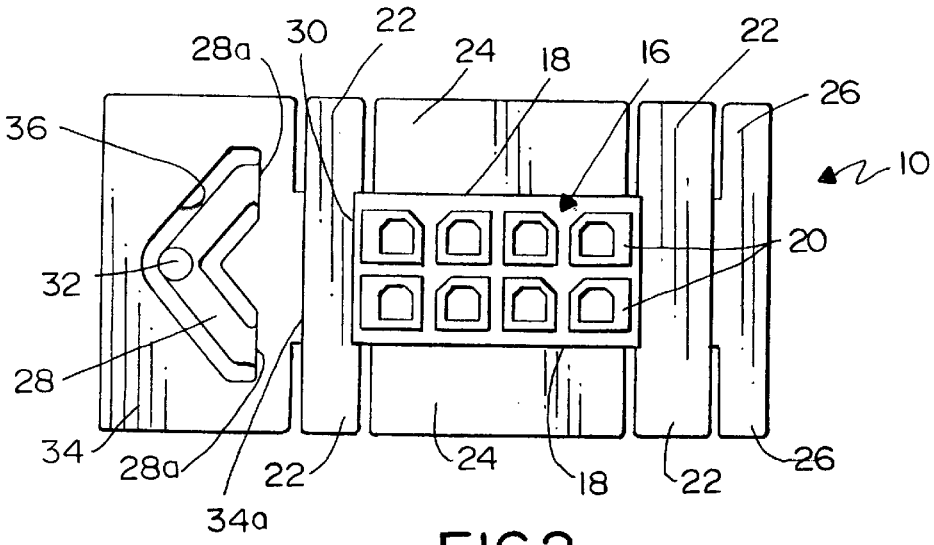
FIG. 2 is a top plan view of the connector.
Figure 3:
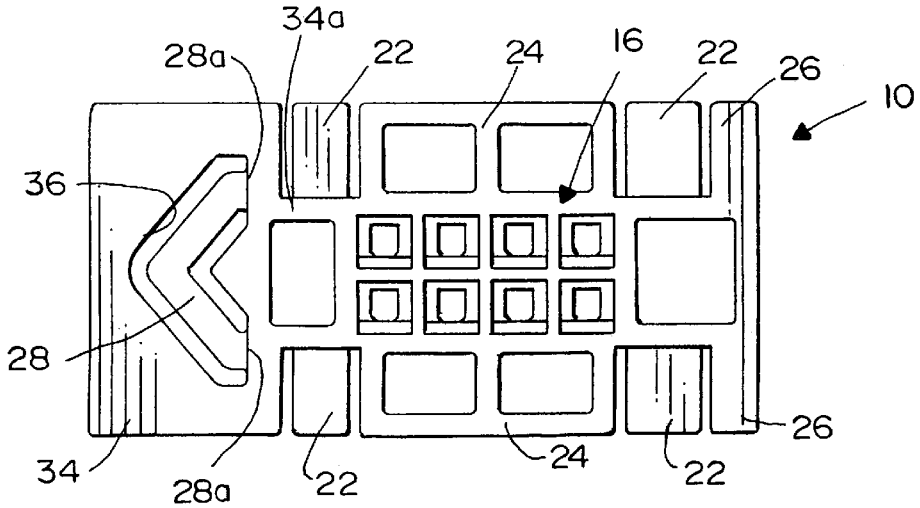
FIG. 3 is a bottom plan view of the connector.
Figure 4:
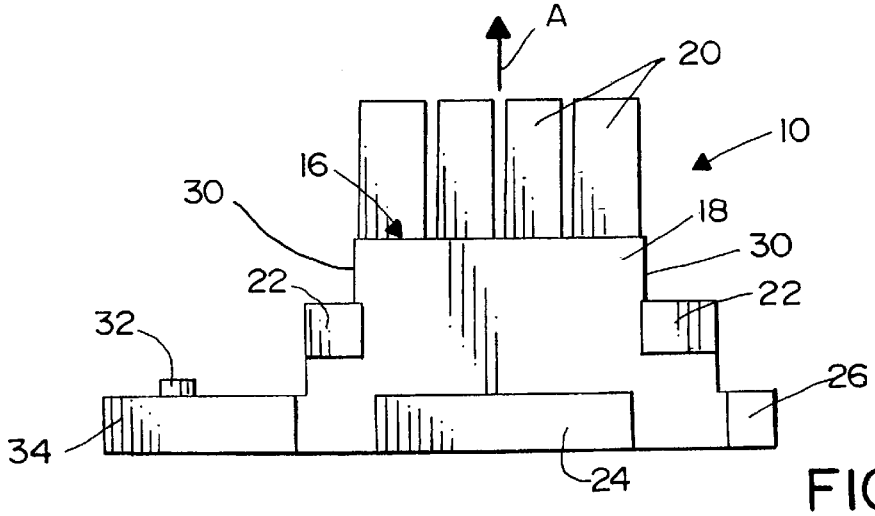
FIG. 4 is a side elevational view of the connector.
Figure 5:
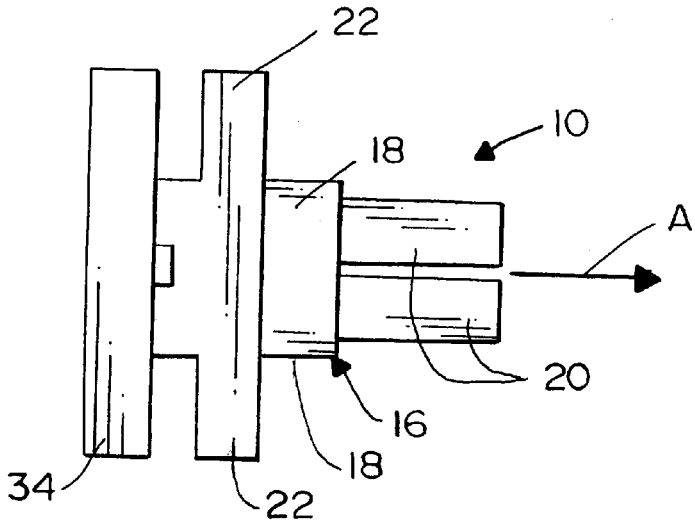
FIG. 5 is an end elevational view of the connector.

Referring to the drawings in greater detail, and first to FIGS. 1–5, in a first embodiment, the invention herein is directed to a system for mounting an electrical connector, generally designated 10, in an opening 12 (FIG. 6) in a panel 14. Connector 10 includes a one-piece housing, generally designated 16, unitarily molded of dielectric material such as plastic or the like. The housing has two opposite sides 18 and a mating end defined by a plurality of "silos" 20 for mating with a complementary connector (not shown). A plurality of terminals (not visible in the drawings) are mounted within silos 20 for engaging appropriate terminals of the mating connector. However, it should be understood that the precise mating configuration of the connector or housing can vary widely and still advantageously incorporate the concepts of the invention.

A pair of locating flanges 22 project outwardly from each side wall 18 of connector housing 16. An elongated stop flange 24 and a narrower stop flange 26 also project outwardly from the outside of each side wall 18. The stop flanges are spaced axially and transversely of locating flanges 22. The locating flanges and the stop flanges are molded integrally with the housing.

A V-shaped latch arm 28 projects outwardly from a third side 30 of connector housing 16 and is integral therewith. An integral latch projection 32 projects axially from latch arm 28 at the apex of the V-shape thereof. A protective shroud in the form of a generally rectangular plate 34 also is molded integrally with housing 16 and projects from third side 30 thereof to substantially surround latch arm 28. The shroud plate has a triangular opening 36 within which the V-shaped latch arm 28 is disposed. Therefore, it can be seen that the latch arm is enclosed within the opening to be surrounded and protected by shroud plate 34.

With the above-described structure, latch arm 28 is relatively narrow in comparison to shroud plate 34 and, therefore, the latch arm is flexible. The latch arm is integrally joined to the housing at relatively narrow junctures 28*a*. On the other hand, shroud plate 34 is fairly massive and is integrally joined to the housing along a wider junction 34*a*. With this structure, the latch arm is relatively flexible and the shroud plate is relatively rigid to provide protection on all three exposed sides of the flexible latch arm.

Figure 6:
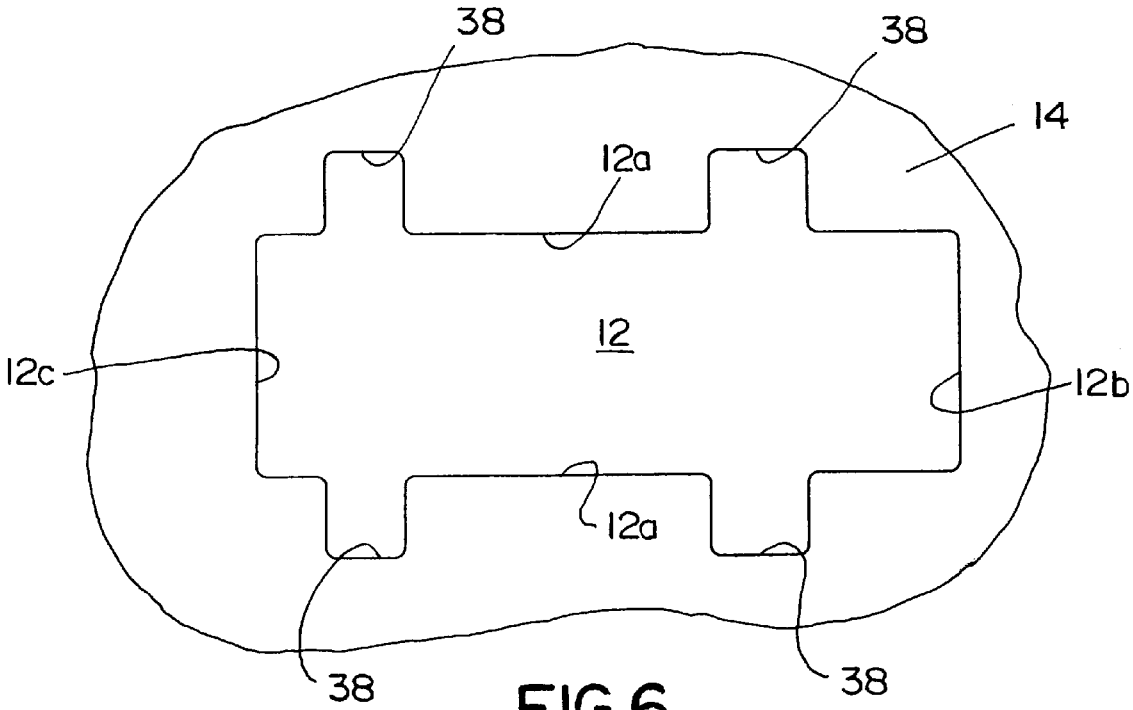
FIG. 6 is a plan view of an opening in a panel within which the connector is mountable.

Referring to FIG. 6, opening 12 in panel 14 is elongated to define longitudinal sides 12*a* and opposite ends 12*b* and 12*c*. A pair of locating slots 38 are located at each opposite longitudinal side 12*a* of the opening and extend radially from the opening. Connector 10 is inserted into opening 12 in an insertion direction as designated by arrows "A" in FIGS. 1, 4 and 5. In essence, the connector is inserted along an axis in a first linear direction indicated by arrows "A". The connector is oriented so that latch arm 28 and shroud plate 34 point in the direction of end 12*c* of opening 12 in panel 14.

Figure 7:
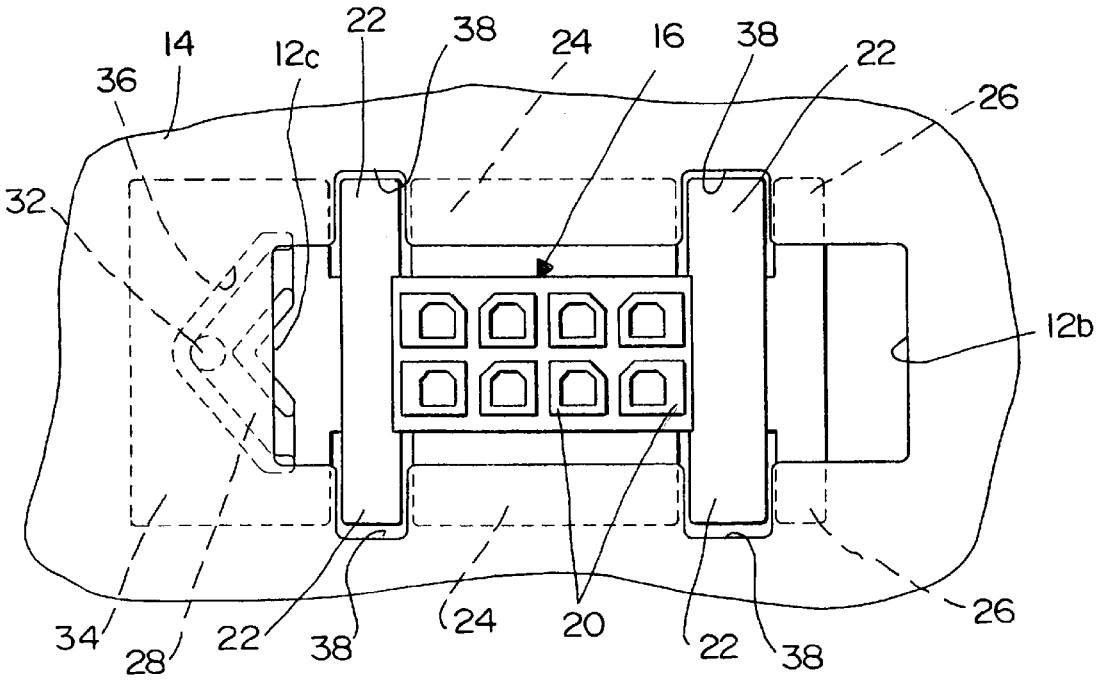
FIG. 7 is a bottom plan view of the connector mounted in the opening in the panel, in its insertion position.
Figure 8:
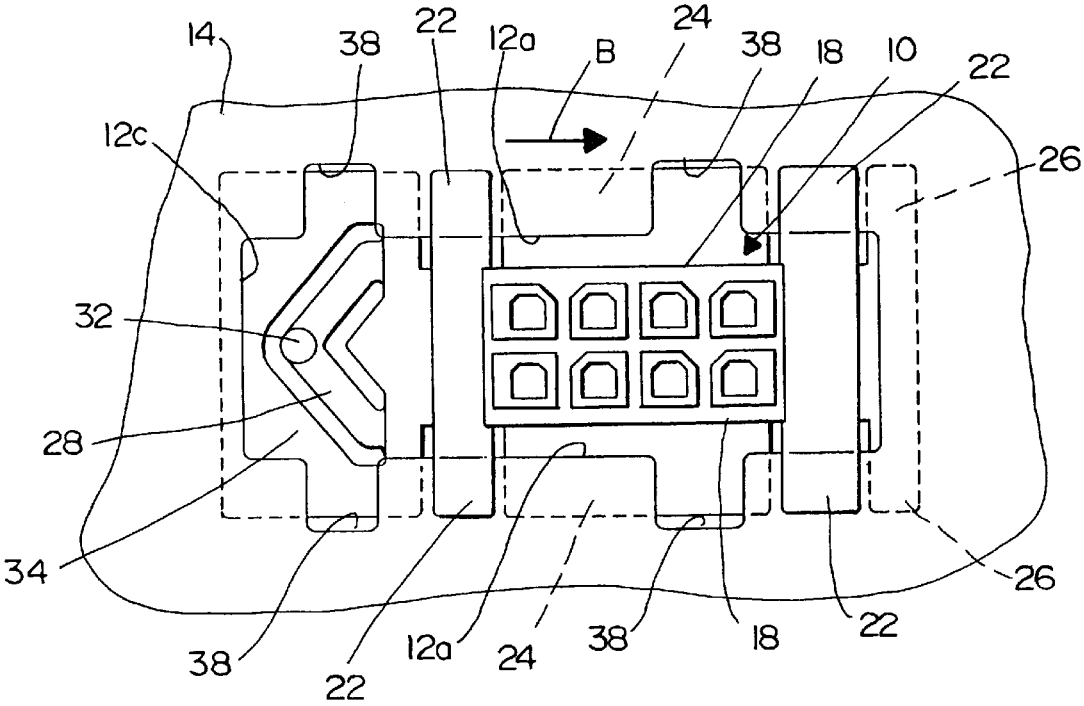
FIG. 8 is a view similar to that of FIG. 7, with the connector moved to its latched position.
Figure 9:
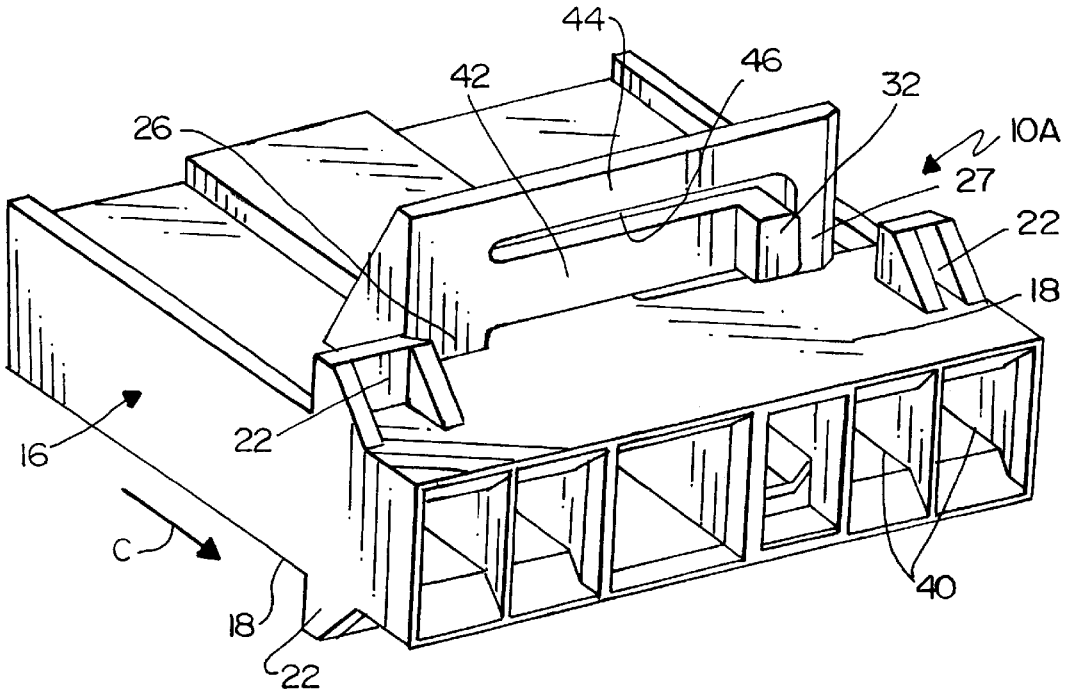
FIG. 9 is a perspective view of a second embodiment of an electrical connector embodying the concepts of the invention.
Figure 10:
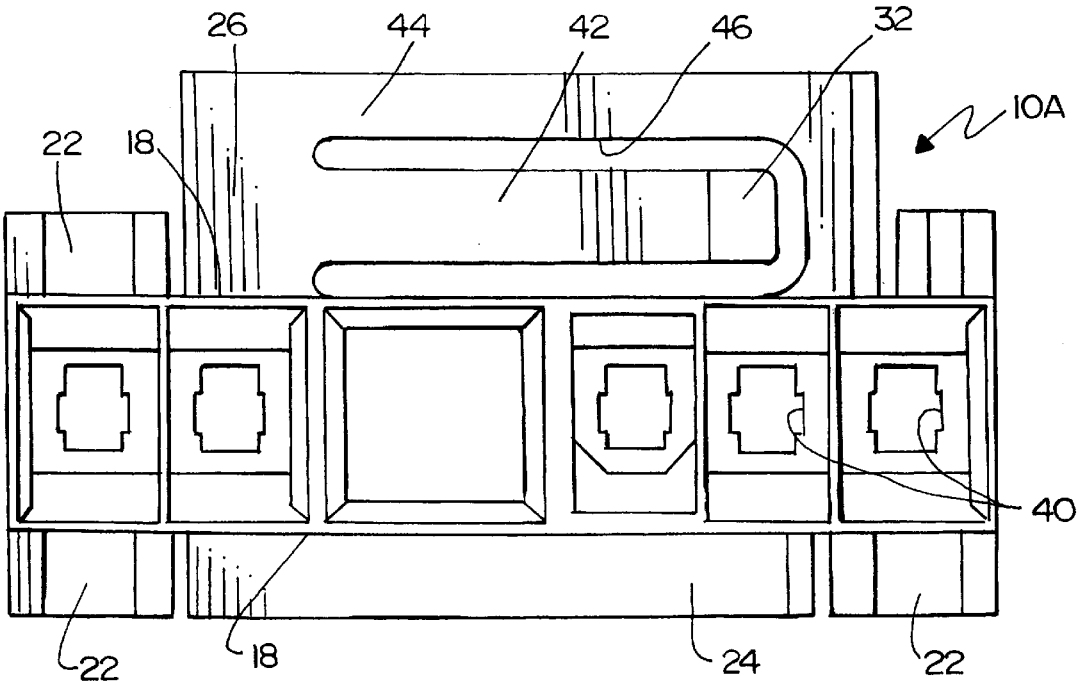
FIG. 10 is a top plan view of the connector of FIG. 9.

FIG. 7 shows the connector inserted into the opening in the panel to its insertion position, and FIG. 8 shows the connector moved to its latched position. More particularly, referring first to FIG. 7, the connector is inserted into the opening in the panel by aligning radially extending locating flanges 22 of the connector housing with radially extending locating slots 38 of the panel opening. The connector is inserted until stop flanges 24 and 26 abut the insertion side of the panel (i.e. the side opposite that viewed in FIGS. 7 and 8). At this point, locating flanges 22 have cleared the opposite side of the panel. In addition, axially extending latch projection 32 on latch arm 28 will engage the insertion side of the panel and cause latch arm 28 to flex or become "cocked".

After the connector has been inserted into the opening in the panel to its insertion position shown in FIG. 7, the connector is moved in a second linear direction as indicated by arrow "B" in FIG. 8 generally parallel to the panel to its final latched position as shown. As the connector is moved from its insertion position to its final latched position, latch projection 32 will move past the edge of the opening in the panel defined by end 12*c* and "snap" into the opening under the energy stored within flexed latch arm 28. The panel now is sandwiched between locating flanges 22 and stop flanges 24 and 26, and latch projection 32 prevents the connector from moving back away from its latched position.

Connector 10 is allowed to "float" within the opening in the panel. In other words, relative movement between the connector and the panel is allowed in a direction generally parallel to the panel. This relative movement is allowed because the distance between sides 18 of the housing is less than the distance between sides 12*a* of the opening as is seen clearly in FIGS. 7 and 8. In addition, it also can be seen in FIG. 8 that latch projection 32 is spaced from end 12*c* of the opening. Therefore, the connector can move in all directions relative to the panel within the opening generally parallel to the panel.

FIG. 8 also shows a feature of the invention whereby the opening in the panel is substantially closed when the connector is moved to its latched position. In other words, looking at FIG. 7, it can be seen that the area adjacent end 12*b* of the opening is open and extraneous objects could pass therethrough. When the connector is moved to close end 12*b* of the opening, instead of the opposite end now becoming open, shroud plate 34 is of a sufficiently large size to close end 12*c* of the opening. Therefore, the shroud plate combines with the housing to substantially close the opening in the panel when the housing is in its latched position. This prevents a finger, a tool or other extraneous object from being inserted through the opening toward electrical components with which the connector might be associated.

FIGS. 9–13 show a second embodiment of the invention which is directed to a system for mounting an electrical connector, generally designated 10A, in an opening 12 (FIG. 11) in a panel 14. Wherever possible, like reference numerals have been applied in FIGS. 9–13 corresponding to like components described above in relation to the first embodiment in FIGS. 1–8.

With that understanding, connector 10A includes a one-piece housing, generally designated 16, unitarily molded of dielectric material such as plastic or the like. The housing has two opposite sides 18 and a mating end defined by a plurality of receptacles 40 for mating with a complementary connector (not shown). A plurality of terminals (not visible in the drawings) are mounted within receptacles 40 for engaging appropriate terminals of the mating connector. Again, it should be understood that the precise mating configuration of connector 10A or housing 16 can vary widely and still advantageously incorporate the concepts of the invention.

A pair of locating flanges 22 project outwardly from each side wall 18 of connector housing 16 of connector 10A. An elongated stop flange 24 on one side of the housing and a pair of narrower stop flanges 26 and 27 also project outwardly from the opposite side of the housing. The stop flanges are spaced axially and, preferably, transversely of locating flanges 22. The locating flanges and the stop flanges are molded integrally with the housing. One of the locating flanges 22 is preferably smaller than the other flanges 22 to provide polarity protection.

An elongated latch arm 42 projects from stop flange 26 generally parallel to the adjacent side 18 of the housing. The latch arm is integral with stop flange 26 and projects therefrom to a distal end of the latch arm which has an axially extending, integral latch projection 32. Therefore, the latch arm is a flexible latch arm.

A protective shroud in the form of an elongated plate 44 extends between stop flanges 26 and 27 and is molded integrally therewith. The shroud plate has an elongated, generally rectangular opening 46 within which latch arm 42 is disposed. Therefore, it can be seen that the latch arm is enclosed within the opening to be surrounded and protected by shroud plate 44. Whereas latch arm 42 is flexible, shroud plate 44 is relatively rigid with stop flanges 26 and 27 to provide protection on all three exposed sides of the flexible latch arm.

Figure 11:
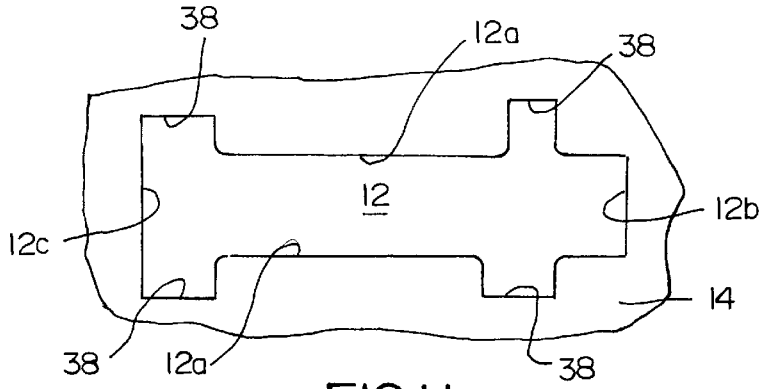
FIG. 11 is a plan view of an opening in a panel within which the connector of FIGS. 9 and 10 is mountable.

FIG. 11 shows opening 12 in panel 14 to be elongated as defined by longitudinal sides 12*a* and opposite ends 12*b* and 12*c*. Like the first embodiment, a pair of locating slots 38 are located at each opposite longitudinal side 12*a* of the opening and extend radially from the opening. Connector 10A is inserted into the opening in an insertion direction as indicated by arrow "C" in FIG. 9. In essence, the connector is inserted along an axis in a first linear direction indicated by arrow "C". The connector is oriented so that latch arm 42 and shroud plate 44 extend generally perpendicular to the linear insertion direction. One of the locating slots 38 is smaller than the other slots 38 for reception of smallest locating flange 22 to provide polarity protection.

Figure 12:
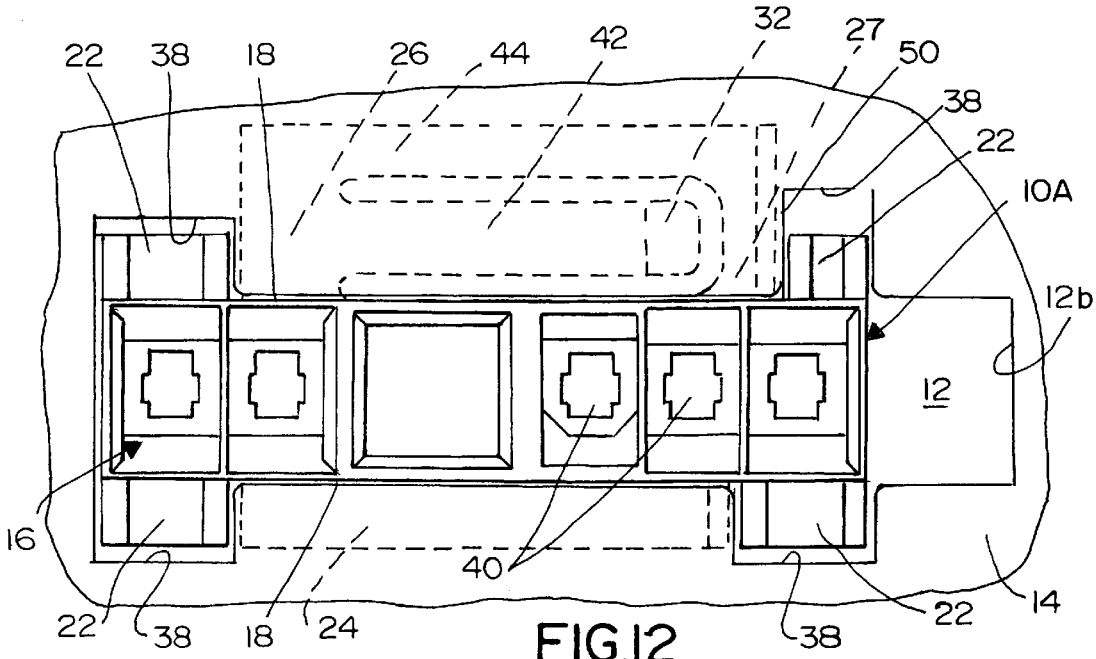
FIG. 12 is a plan view of the connector mounted in the opening in the panel of FIG. 11, with the connector in its insertion position.
Figure 13:
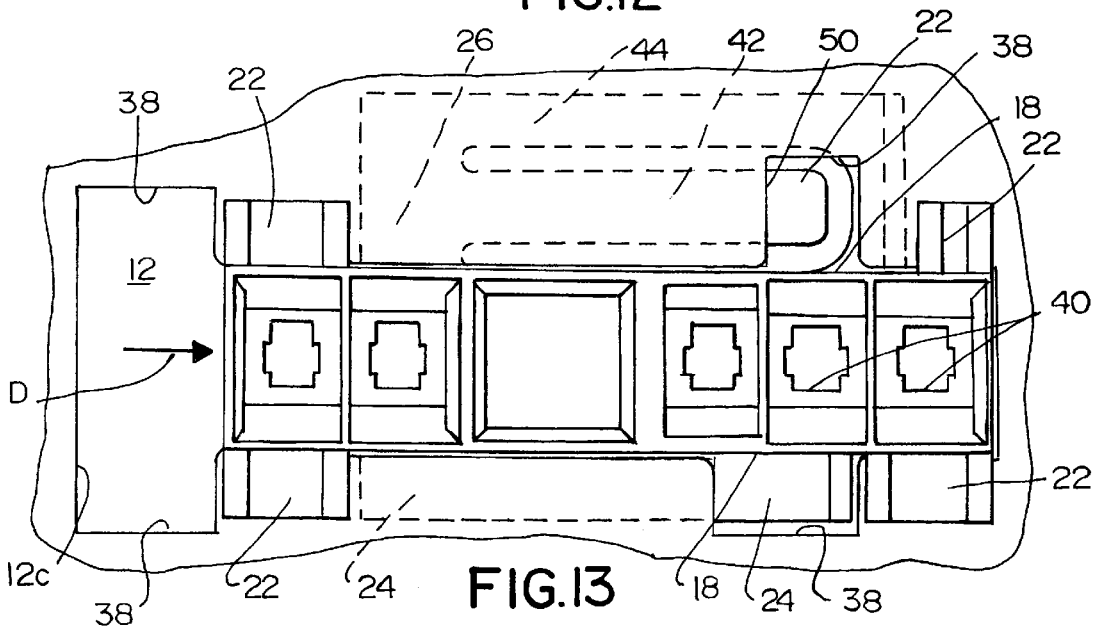
FIG. 13 is a view similar to that of FIG. 12, with the connector moved to its latched position.

FIG. 12 shows connector 10A inserted into opening 12 in panel 14 to its insertion position, and FIG. 13 shows the connector moved to its latched position. More particularly, referring to first to FIG. 12, the connector is inserted into the opening in the panel by aligning radially extending locating flanges 22 of the connector housing with radially extending locating slots 38 of the panel opening. The connector is inserted until stop flanges 24, 26 and 27 abut the insertion side of the panel (i.e., the side opposite that viewed in FIGS. 12 and 13). At this point, locating flanges 22 have cleared the opposite side of the panel. In addition, axially extending latch projection 32 on latch arm 42 will engage the insertion side of the panel and cause latch arm 42 to flex or become "cocked".

After connector 10A has been inserted into the opening in the panel to its insertion position shown in FIG. 12, the connector is moved in a second linear direction as indicated by arrow "D" in FIG. 13 generally parallel to the panel to its final latch position as shown. As the connector is moved from its insertion position to its final latched position, latch projection 32 will move past a side edge 50 of one of the locating slots 38 in the panel and "snap" into the slot under the energy stored within flexed latch arm 42. The panel now is sandwiched between locating flanges 22 and stop flanges 24, 26 and 27. Latch projection 32 prevents the connector from moving back away from its latched position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A system for mounting an electrical connector in a panel, comprising:

a panel having first and second sides and an opening with at least one locating slot extending radially from the opening;

a connector having a housing insertable from one side of the panel along an axis to an insertion position into the opening in the panel, the housing having at least one radially extending locating flange for passing through the locating slot of the opening as the housing is inserted thereinto and at least one radially extending stop flange spaced axially from the locating flange for abutting the one side of the panel when the locating flange clears the opposite side of the panel, the housing being movable transverse to said axis within the opening in the panel from said insertion position to a latched position;

a latch arm projecting from the connector housing and engageable with a latch surface on the panel when the housing is in said latched position; and a protective shroud about a substantial portion of the latch arm to protect the latch arm against breakage.

2. The system of claim 1, including at least one said locating flange and at least one said stop flange on each of two opposite sides of the connector housing.

3. The system of claim 2 wherein said latch arm and said protective shroud are located at a third side of the connector housing.

4. The system of claim 2 wherein said latch arm and said protective shroud are located at one of said opposite sides of the connector housing.

5. The system of claim 1 wherein said latch surface on the panel comprises an edge of the opening in the panel.

6. The system of claim 5 wherein said latch arm includes a latch projection for engaging said edge of the opening.

7. The system of claim 1 wherein said latch surface on the panel comprises an edge of said locating slot.

8. The system of claim 7 wherein said latch arm includes a latch projection for engaging said edge of the slot.

9. The system of claim 1 wherein said latch arm comprises a flexible latch arm and said protective shroud comprises a rigid shroud.

10. The system of claim 9 wherein said latch arm and said shroud are integral with the connector housing.

11. The system of claim 1 wherein said protective shroud is of a sufficiently large size to combine with the housing to substantially close the opening in the panel when the housing is in said latched position.

12. The system of claim 1 wherein said latch arm and said shroud are integral with the connector housing.

13. The system of claim 1 wherein said latch arm comprises a flexible latch arm projecting from said at least one stop flange.

14. The system of claim 13 wherein said protective shroud extends between a pair of said stop flanges including said at least one stop flange.

15. A system for mounting an electrical connector in a panel, comprising:

a panel having first and second sides and an opening with at least one locating slot extending radially from at least two opposite sides thereof;

a connector having a housing insertable from one side of the panel along an axis to an insertion position into the opening in the panel, the housing having at least one radially extending locating flange on each of two opposite sides of the housing for passing through the locating slots of the opening as the housing is inserted thereinto, and at least one radially extending stop flange on each of the opposite sides of the housing spaced axially and transversely from the locating flange at that side of the housing for abutting the one side of the panel when the locating flanges clear the opposite side of the panel, the housing being movable transverse to said axis within the opening in the panel from said insertion position to a latched position;

a flexible latch arm integral with the housing and projecting from a third side of the housing, the flexible latch arm being engageable with a latch surface on the panel when the housing is in said latched position; and a rigid shroud integral with the housing at said third side thereof and disposed about a substantial portion of the flexible latch arm to protect the latch arm against breakage.

16. The system of claim 15 wherein said latch surface on the panel comprises an edge of the opening in the panel.

17. The system of claim 16 wherein said latch arm includes a latch projection for engaging said edge of the opening.

18. The system of claim 15 wherein said protective shroud is of a sufficiently large size to combine with the housing to substantially close the opening in the panel when the housing is in said latched position.

19. A system for mounting an electrical connector in a panel, comprising:

a panel having first and second sides and an opening with at least one locating slot extending radially from at least two opposite sides thereof;

a connector having a housing insertable from one side of the panel along an axis to an insertion position into the opening in the panel, the housing having at least one radially extending locating flange on each of two opposite sides of the housing for passing through the locating slots of the opening as the housing is inserted thereinto, and at least one radially extending stop flange on each of the opposite sides of the housing spaced axially from the locating flange at that side of the housing for abutting the one side of the panel when the locating flanges clear the opposite side of the panel, the housing being movable transverse to said axis within the opening in the panel from said insertion position to a latched position;

a flexible latch arm integral with the housing and projecting from one of said opposite sides of the connector housing, the flexible latch arm being engageable with an edge of said at least one locating slot when the housing is in said latched position; and a rigid shroud integral with the housing at said one opposite side thereof and disposed about a substantial portion of the flexible latch arm to protect the latch arm against breakage.

20. The system of claim 19 wherein said latch arm includes a latch projection for engaging said edge of the slot.

21. The system of claim 19 wherein said flexible latch arm projects from said at least one stop flange.

22. The system of claim 21 wherein said protective shroud extends between a pair of said stop flanges including said at least one stop flange.

23. A system for mounting an electrical connector in a panel, comprising:

a panel having first and second sides and an opening with at least one locating slot extending radially from the opening;

a connector having a housing insertable from one side of the panel along an axis in a first linear direction to an insertion position into the opening in the panel, the housing having at least one radially extending locating flange for passing through the locating slot of the opening as the housing is inserted thereinto and at least one radially extending stop flange spaced axially from the locating flange for abutting the one side of the panel when the locating flange clears the opposite side of the panel, the housing being movable within the opening in the panel in a second linear direction transverse to said first linear direction from said insertion position to a latched position;

a latch means on the connector housing engageable with a latch surface on the panel when the housing is in said latched position; and an enlargement projecting from the housing and of a sufficiently large size to combine with the housing to substantially close the opening in the panel when the housing has been moved in the second linear direction to its latched position.

24. The system of claim 23 wherein said latch means comprises a flexible latch arm and said enlargement comprises a plate about the flexible latch arm.

25. The system of claim 24 wherein said latch arm and said plate are located at a trailing side of the connector housing in relation to said movement of the housing in said second linear direction.

26. The system of claim 24 wherein said enlargement is located at a trailing side of said housing in relation to said movement of the housing in said second linear direction.

* * * * *